United States Patent [19]

Reitter

[11] 4,363,232

[45] Dec. 14, 1982

[54] TOOL FOR SHAPING SHEET METAL

[75] Inventor: Erhardt Reitter, Sulzfeld, Fed. Rep. of Germany

[73] Assignee: Uniplanung Metall-und Kunststoff-Engineering GmbH & Co. KG, Dumersheim, Fed. Rep. of Germany

[21] Appl. No.: 211,895

[22] Filed: Dec. 1, 1980

[30] Foreign Application Priority Data

Dec. 1, 1979 [DE] Fed. Rep. of Germany ..... 2948396

[51] Int. Cl.[3] ..... B21D 22/00

[52] U.S. Cl. ..... 72/350; 72/347

[58] Field of Search ..... 72/347, 351

[56] References Cited

U.S. PATENT DOCUMENTS

| | | | |
|---|---|---|---|
| 2,796,253 | 6/1957 | Schulje | 72/431 X |
| 3,664,172 | 5/1972 | Cvacho | 72/350 |
| 4,036,056 | 7/1977 | Saunders | 72/350 |
| 4,090,389 | 5/1978 | Denderer et al. | 72/379 |

*Primary Examiner*—Leon Gilden

*Attorney, Agent, or Firm*—Max Fogiel

[57] ABSTRACT

A sheet metal tool as two relatively movable tool sections, one of which is provided adjacent its sheet metal-shaping face with a sheet metal holder which is movable relative to that face. Also movable relative to that face is a pressure-distributing unit composed of two spaced parallel plates which are maintained at a predetermined distance by spacers, this unit serving as an abutment for the sheet metal holder.

4 Claims, 4 Drawing Figures

TOOL FOR SHAPING SHEET METAL

BACKGROUND OF THE INVENTION

The present invention relates to a tool in general, more particularly to a tool for shaping of sheet metal. Still more specifically, the invention relates to a drawing tool for shaping of sheet metal.

Tools of this type are used, for example, to shape kitchen sinks from one-piece sheets of metal, usually stainless steel. Such tools have an upper part and a lower part between which the sheet metal to be shaped is placed, and of which at least one is movable relative to the other toward and away therefrom. One of the parts has a matrix and a drawing ring with drawing edges and the other tool part has a usually fixed drawing die and a sheet metal holder which is movable relative to the drawing die. Conventionally, such sheet metal holders are supported—if small tools are involved—by springs; if larger tools are involved or tools for larger parts to be drawn are involved, the sheet metal holders are supported against a drawing cushion of a press which holds the tool.

These prior-art arrangements are not fully satisfactory, particularly because if relatively large sheet metal members are to be shaped by drawing, presses with integrated drawing cushions are required against which the sheet metal holders are supported via pressure bolts. The drawing of such sheet metal parts thus requires the presence of double-acting presses and cannot be carried out on single-acting presses. This is a disadvantage because there are many instances where a double-acting press is not available and/or it is not economically feasible to acquire one.

SUMMARY OF THE INVENTION

Accordingly, it is an object of the invention to overcome the disadvantages of the prior art.

A more particular object of the invention is to provide a tool for shaping—particularly drawing—sheet metal which is capable of operating independently of the presence or absence of a draw press mounting the tool and having an integrated drawing cushion, but which nevertheless assures sufficiently good sheet metal retention to meet the requirements of even large workpieces, including those of e.g. stainless steel.

Pursuant to these objects, and still others which will become apparent hereafter, one aspect of the invention resides in a tool for shaping—particularly drawing—sheet metal, which may comprise an upper tool section and a lower tool section mounted for movement towards and away from one another. A sheet metal holder is provided on one of the sections and movable relative to a sheet metal-shaping contour thereof. Pressure distributing means is also movable relative to the shaping contour and includes two spaced-apart plates and spacers connecting the plates and maintaining them at a predetermined distance, the pressure distributing means constituting an abutment for the sheet metal holder.

In a tool according to the present invention the sheet metal holder can be dimensioned in accordance with the requirements of the particular workpiece to be produced. In contrast, when the sheet metal holder was supported via pressure pulls against the draw cushion of a press, it was always necessary to dimension the tool to the precise raster size of the bolt guides provided for example in the press table. This frequently led to two constructions which had to be made very large with respect to the part to be produced and had to be heavily dimensioned because of various force moments that were likely to occur in operation. The use, in the tool of the invention, of a pressure distributing plate composed of two individual plates which are maintained at a predetermined spacing from one another, makes it possible to configurate and construct the sheet metal holder in accordance with the requirements of the workpiece to be produced, which leads to tools which can be light in weight, relatively small in size and therefore as a rule much more economical to produce than those known from the prior art.

Of course, there are various ways in which the two plates of the pressure distributing means or plate can be maintained at a spacing from one another, in such a manner that they cannot shift relative to one another and are nevertheless reliably connected with one another so as to be the equivalent of a one-piece plate in terms of strength. The use of spacer sleeves, as will be discussed in more detail hereinafter, is particularly advantageous but is only one exemplary embodiment. The spacer sleeves are advantageously maintained in tension between the individual plates of the pressure distributing means, and this also can be accomplished in a variety of ways, including those to be discussed hereinafter and others which will offer themselves to those skilled in the art. Resort to the particular possibility to be described hereinafter has an advantage, in that the means connecting the two individual plates with one another and putting the spacer sleeves in tension, are located within the spacer sleeves which results in a clear positioning of the two associated plates and a uniformly centric load application in the area of the spacer sleeves.

According to another advantageous embodiment of the invention the spacer sleeves may themselves be constructed as working cylinders into which working fluid (gaseous or liquid working fluid) can be admitted, and which each accommodate a piston that is axially shiftable in the respective sleeve and extends out of the same with a piston rod and through one of the plates, and a side of which that is remote from the sleeves is engaged by the respective piston rod.

The invention will hereinafter be described with reference to exemplary embodiments illustrated in the appended drawings. It is to be understood, however, that these are for purposes for explanation only and not to be considered limiting.

DESCRIPTION OF PREFERRED EMBODIMENTS

Figure 1:
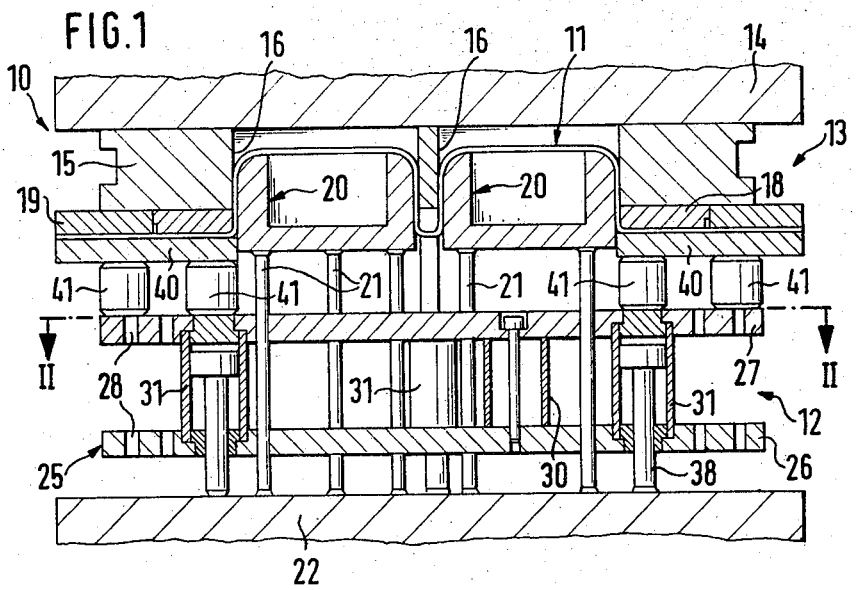
FIG. 1 is a vertical longitudinal section through a tool according to the present invention, here configurated for drawing a dual-basin kitchen sink from stainless steel sheet.
Figure 2:
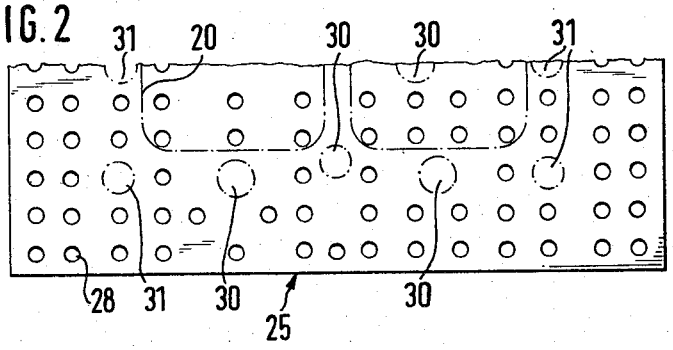
FIG. 2 is a fragmentary sectional view, taken on line II—II of FIG. 1, showing the pressure distributing plate by itself.
Figure 3:
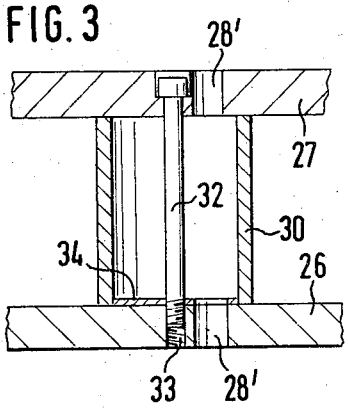
FIG. 3 is an enlarged fractional detail view of FIG. 1, showing in a section the connection of the individual plates of the spacing element by means of a spacer sleeve and a tension anchor going through it.

Referring now firstly to FIGS. 1–3, it will be seen that the tool illustrated therein is a drawing tool 10 the purpose of which is to draw or shape dual-basin kitchen sinks from stainless steel sheet, the sink being the workpiece which is identified with reference numeral 11. The tool has a lower part 12 which is mountable on a press table and an upper part 13 which is connectable with a press ram and is movable upwardly and downwardly with reference to the lower part 12. An intermediate plate 15 is connected in the upper part with a cover plate 14 which serves for connection to the press ram or plunger and recesses 16 are formed in the plate 15 which correspond to the shape of the sink to be produced. At the underside of the plate 15 there is provided the so-called draw ring 18 which is surrounded by a plate 19 that is also rigidly connected with the intermediate plate 15. The thickness of the plate 19 is equal to the thickness of the draw ring 18 and it cooperates with the sheet metal holder of the lower part 13 which will be described later. The draw ring 18 is a plate which is provided with recesses corresponding to the shape of the workpiece 11 to be produced and which are provided with draw curves at the undersides of the plate.

The lower part 12 of the tool has the rams 20 which correspond in shape to the shape of the basins of the sink 11 to be produced. These rams 20 are supported via bolts 21 on a base plate 22 of the lower part 12 or on the press table on which the lower part 12 is to be mounted. These rams 20 are fixedly connected with the base plate 22 or with the press table (this is not shown in detail in order to avoid complicating the drawing) and are thus held in position so that they cannot shift. Interposed between the rams 20 and the plate 22 of the lower part 12 of the tool or of the press table. There is provided a pressure distributing plate which is identified in toto with reference numeral 25 and which is vertically movable. One half of the plate 25 is shown in a top plan view in FIG. 2.

As FIGS. 1 and 3 show most clearly, the plate 25 is composed of two individual plates 26 and 27 which are arranged at a spacing from one another in parallel planes and are rigidly connected with one another. The plates 26, 27 are provided with sets of registering holes 28 which are arranged in a predetermined grid pattern or raster over the surface of the plate 25 and through which the bolts 21 extend which support the rams 20 with reference to the base plate 22 or the press table. If additional ones of the holes 28 are needed beyond those of the predetermined grid pattern, then they can be drilled as a simple matter into the plates of the pressure distributing plate 25.

These individual plates 26, 27 of the plate 25 are spaced from one another by cylindrical sleeves 30, 31 which are located between them. The sleeves 30 are pure distancing sleeves and through each of them an anchoring screw 32 extends which connects the two plates 26 and 27 with one another. The heads of the screws 32 are recessed in depressions of the upper plate 27 and their lower ends are threaded into tapped bores 33 of the lower plate 26. Positioning discs arranged at the upper side of the lower plate 26 serve to position the sleeves which are maintained in tension between the plates 26, 27 by means of the screws 32; these positioning plates or discs have a recess which is aligned with tap bore 33 in the lower plate. As shown at 28' in FIG. 3, registering bores may be provided in the two plates within the area surrounded by a respective spacing sleeve 30, and of course in such a case the positioning disc 34 must also be provided with a corresponding registering opening.

Figure 4:
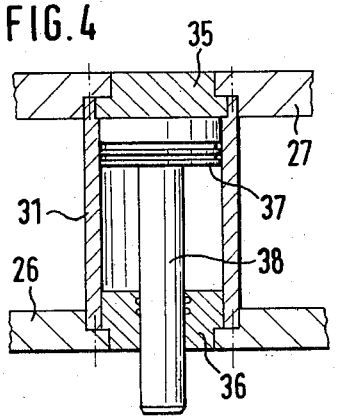
FIG. 4 is a view analogous to FIG. 3, but showing a further detail of the embodiment in FIGS. 1–3.

Whereas the sleeves 30 serve purely as spacing sleeves, the sleeves 31 (see FIG. 4) constitute working cylinders which are integrated with the pressure distributing plate 25 and the ends of which are closed by respective covers 35, 36. The connection of these sleeves, the covers 35, 36 closing the ends of the sleeves or cylinders, and the connection of the overall arrangement with the upper and lower plates 26, 27 are not illustrated in detail because various solutions are possible which will offer themselves to those skilled in the art. For example, the covers 35, 36 may be threaded onto the open ends of the sleeves 31 (constituting the working cylinders) and the sleeves may be connected by means of screws extending through the plates 26, 27 and into the closed ends of the cylinders, the heads of these screws being received in countersunk or depressed recesses of the plates 26, 27.

Each of the sleeves 31 constituting a working cylinder accommodates a piston 37 which is axially slidable therein and which at the side remote from the upper part 13 of the tool has a piston rod 38 that extends through the cover 36 (which is for this purpose provided with an appropriate guide opening) and beyond the lower side of the pressure distributing plate 25. These piston rods rest on the base plate 22 of the lower part 12 of the tool or on the press table. The cylinder and piston arrangements may be connected to the hydraulic system of a press or to a separate hydraulic system provided only to service the particular tool.

The tool 10 is provided with a sheet metal holder 40 which is shaped in correspondence with the workpiece to be produced, i.e. here with the dual-basin kitchen sink 11. The sheet metal holder 40 is supported via pressure members 41 against the upper side of the pressure distributing plate 25, in other words against the upper plate 27 thereof.

The pressure distributing plate 25 is vertically movable with reference to the rams 20 which are stationarily supported on the base plate 22 of the lower tool part 12 or on the press table. When the upper part of the tool, identified with reference numeral 13, is raised to a position in which the draw ring 18 is vertically spaced from the upper edge of the rams 20, the pressure distributing plate 25 has moved—by application of pressure fluid to the integrated working cylinder 31—to a position immediately below the rams 20 and the sheet metal holder 40 which is supported via the pressure members 41 against the upper side of the pressure distributing plate 25, is essentially located in a plane with the upper edge of the rams 20 or else in a plane which is slightly higher than the upper edge of the rams 20. A sheet metal member is now placed into the tool 10. If, thereafter, the upper part 13 of the tool is lowered, the draw ring 18 seats in the region of the sheet metal holder 40 onto the plate resting thereon, so that the sheet metal plate is held between the draw ring and the sheet metal holder 40 with a force corresponding to the supporting force of the working cylinders 31 of the plate 25. During the further downward movement of the upper part 13 of the tool the plate to be converted into a workpiece is drawn in known manner over the rams 20 which are stationarily supported by means of the bolts 21, and during this movement the formation of folds in the plate is avoided because of the manner in which the edge of the plate is held due to its clamping between the sheet metal holder 40 and the draw ring 18; this latter feature is known.

The downward movement of the sheet metal holder 40 takes place counter to the supporting force supplied by the work cylinders 31, which results from the fact that the pressure distributing plate 25 with the indicated working cylinders descends relative to the piston rods 38 of the pistons 39 which rest on the base plate 22 or on the press table on which the lower tool part is supported, whereby the pressure medium accommodated in the working cylinders 31 flows out of the working cylinders 31 (as the piston 39 enter deeper into them) against a predetermined flow resistance. As soon as the drawing operation is completed, the upper tool part 13 rises again, to a position at which the now completed workpiece 11 can be removed from the tool, and the workpiece is expelled by moving the pressure distributing plate 25 and thus the sheet metal holder 40 upwardly. The manner in which the movement of the sheet metal holder 40 and the movement of the working cylinders 31 is controlled, need not be discussed separately because this is of course known per se from sheet metal drawing tools.

It is advantageous if the upper and lower plates 26, 27 have recesses into which the ends of the sleeves 31 constituting the working cylinders are received. These recesses may be closed by means of inserts received in them and also tightly received in or secured to the open ends of the sleeves 31, but of course one of these inserts must be provided with an opening for the piston rod to extend therethrough and with a seal sealing the opening with respect to the piston rod.

One of the particular advantages of the tool according to the present invention resides in the fact that the drawing action, which heretofore could only be carried out with double-acting drawing presses, can now be carried out with the use of single-acting presses. The reason for this is that in place of the drawing cushions which according to the prior state of the art were integrated into the drawing presses, the pressure distributing plate 25 with its integrated working cylinders 31 now performs the function of the drawing cushion and thus makes the separate provision of such a drawing cushion unnecessary. The result is a tool which accomplishes the operations of prior-art tools with all advantages thereof, but eliminates the disadvantages which have been felt to be objectionable.

What is claimed is:

1. Tool for shaping—particularly drawing—of sheet metal, comprising a movable upper tool section mounting a die and a field lower tool section mounting a punch mounted for movement towards and away from one another; a sheet metal holder provided on one of said sections and movable relative to a sheet metal-shaping contour thereof; and pressure distributing means also movable relative to said shaping contour and including two spaced-apart plates and spacers connecting said plates and maintaining them at a predetermined distance, said pressure distributing means constituting an abutment for said holder; said spacers comprising tubular spacing sleeves arranged between said plates; said sleeves each comprising a cylinder of a fluid-operated cylinder and piston unit, and a piston slidable back and forth in said cylinder; said piston being supported at one side of said pressure distributing means by a piston rod extending through one of said spaced-apart plates.

2. Tool as defined in claim 1, said spacer sleeves being mounted in compression between said plates.

3. Tool as defined in claim 1, said plates having facing major surfaces provided with respective registering depressions, and said sleeves each having spaced axial ends received in the respective ones of said registering depressions.

4. Tool as defined in claim 3, and further comprising inserts received in said depressions and sealing the spaced axial ends of said sleeves.

* * * * *